US007757920B2

(12) United States Patent
Shea et al.

(10) Patent No.: US 7,757,920 B2
(45) Date of Patent: Jul. 20, 2010

(54) COMBUSTION NAILER WORKPIECE CONTACT ELEMENT WITH ENHANCED GRIPPING

(75) Inventors: Maureen L. Shea, Glenview, IL (US); Julius Schwartzenberger, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 60 days.

(21) Appl. No.: 12/093,071

(22) PCT Filed: Nov. 8, 2006

(86) PCT No.: PCT/US2006/043448

§ 371 (c)(1),
(2), (4) Date: May 8, 2008

(87) PCT Pub. No.: WO2007/056438

PCT Pub. Date: May 18, 2007

(65) Prior Publication Data

US 2008/0264997 A1 Oct. 30, 2008

Related U.S. Application Data

(60) Provisional application No. 60/734,825, filed on Nov. 9, 2005.

(51) Int. Cl.
*B25C 1/04* (2006.01)

(52) U.S. Cl. ..... 227/8; 227/119; 227/142

(58) Field of Classification Search ..... 227/8, 227/120, 130, 119, 140, 142
See application file for complete search history.

(56) References Cited

U.S. PATENT DOCUMENTS

| | | | | |
|---|---|---|---|---|
| 5,219,110 | A * | 6/1993 | Mukoyama | 227/8 |
| 5,263,842 | A * | 11/1993 | Fealey | 227/8 |
| 5,715,982 | A * | 2/1998 | Adachi | 227/8 |
| 5,816,468 | A * | 10/1998 | Yang | 227/8 |
| 6,209,770 | B1 * | 4/2001 | Perra | 227/8 |
| 6,557,745 | B2 * | 5/2003 | Wang | 227/142 |
| 6,581,815 | B1 * | 6/2003 | Ho et al. | 227/142 |
| 6,783,044 | B2 * | 8/2004 | Perra et al. | 227/8 |
| 6,959,850 | B2 * | 11/2005 | Taylor et al. | 227/8 |
| 6,988,648 | B2 * | 1/2006 | Taylor et al. | 227/142 |
| 7,055,729 | B2 * | 6/2006 | Taylor et al. | 227/142 |
| 2004/0149800 | A1 | 8/2004 | Perra et al. | |

FOREIGN PATENT DOCUMENTS

EP 1236544 A 9/2002

OTHER PUBLICATIONS

ISR for PCT/US2006/043448 dated Mar. 23, 2007.

* cited by examiner

*Primary Examiner*—Scott A. Smith
(74) *Attorney, Agent, or Firm*—Lowe Hauptman Ham & Berner, LLP

(57) ABSTRACT

A combustion-powered driving tool for propelling fasteners into a workpiece includes a housing, a power source located in the housing, a nosepiece associated with a lower end of the power source, a magazine associated with the housing and constructed and arranged for storing and sequentially feeding a plurality of fasteners to the nosepiece, and a workpiece contact element associated with the nosepiece and including at least one tooth extending from the workpiece contact element and being constructed and arranged for engaging the workpiece to enable the tool to actuate when the magazine is arranged generally parallel to the workpiece.

16 Claims, 3 Drawing Sheets

COMBUSTION NAILER WORKPIECE CONTACT ELEMENT WITH ENHANCED GRIPPING

RELATED APPLICATIONS

The present application is based on International Application Number PCT/US2006/043448 filed Nov. 8, 2006, and claims priority from U.S. Application No. 60/734,825 filed Nov. 9, 2005, the disclosures of which are hereby incorporated by reference herein in their entirety.

BACKGROUND OF THE INVENTION

The present invention relates to an improved nose assembly for fastener driving tools. More specifically, the present invention relates to improvements in workpiece contact elements for such tools.

Fastener-driving tools are typically powered by pneumatic, combustion, electric, or powder systems, and the present workpiece contact element is contemplated as usable on fastener driving tools regardless of the power system. However, the main focus of the present work contact element will be on its use with combustion-powered framing tools, such as those manufactured by ITW Paslode under the IMPULSE® brand.

Combustion-powered tools, also referred to as combustion nailers, are known in the art, and exemplary tools produced by Illinois Tool Works of Glenview, Ill., also known as IMPULSE® brand tools for use in driving fasteners into workpieces, are described in commonly assigned patents to Nikolich U.S. Pat. Re. No. 32,452, and U.S. Pat. Nos. 4,522,162; 4,483,473; 4,483,474; 4,403,722; 5,197,646; 5,263,439; 5,897,043 and 6,145,724 all of which are incorporated by reference herein.

Such tools generally incorporate a tool housing enclosing a small internal combustion engine. The engine is powered by a canister of pressurized fuel gas called a fuel cell. A battery-powered electronic power control unit produces the spark for ignition, and a fan located in the combustion chamber provides for both efficient combustion within the chamber, and facilitates scavenging, including the exhaust of combustion by-products.

The engine includes a reciprocating piston having an elongate, rigid driver blade reciprocating inside a cylinder having an attached nosepiece. Fasteners are fed to the nosepiece from a magazine where they are held in a properly positioned orientation for receiving the impact of the driver blade.

Generally, when a user wishes to actuate the tool, they place the workpiece contact element against the workpiece and depress the tool housing relative to the workpiece contact element. Through the connection of the workpiece contact element to a sliding valve sleeve in the combustion engine, this action closes the combustion chamber. In a sequential mode of operation, once the user pulls the trigger, the combustion is initiated. Upon ignition of a gas/air mixture in the combustion chamber, the piston/driver blade is driven down the sleeve or cylinder. A leading end of the driver blade engages a fastener and drives it along a channel defined by the nosepiece into a workpiece. The piston and driver are then returned to the original, pre-firing position by differential gas pressures.

However, due certain awkward application angles, the workpiece contact element may not be able to properly grip the workpiece, which may prevent proper tool actuation. In addition, in some tool application angles, a user may not be able to hold the tool in place, causing the fastener to propel into the workpiece at an unsatisfactory angle, or preventing the fastener from properly penetrating the workpiece.

To address this problem, fastener-driving tools have been developed where the workpiece contact element includes teeth constructed and arranged for gripping the workpiece during actuation for preventing movement of the tool. Specifically, pneumatic-powered fastener driving tools typically have a cylindrical or round nose with teeth about the periphery. This arrangement facilitates fastener driving in many angular orientations and in tight spaces. Generally, in combustion tools, the workpiece contact element is rectangular to slidingly engage a similarly shaped nosepiece, and teeth are located at the front and sides of the element. The teeth are generally configured for engaging the workpiece when a longitudinal axis of the tool is arranged perpendicular or at an angle to the workpiece, and the magazine is oriented at an inclined angle to the workpiece.

Although this configuration is acceptable in some instances, combustion powered nailers used in framing, also called framing tools, are frequently used to perform "toenailing." During toenailing, a fastener is propelled at an angle to join two perpendicularly arranged workpieces such as wooden studs. This application is contrasted with typical tool orientation, where the tool is usually perpendicular to the workpiece. However, during toenailing, the tool must be positioned at an angle such that the magazine is arranged generally parallel to the workpiece. In this orientation, it can be difficult for many current combustion tools to actuate, because the workpiece contact element teeth are not properly oriented to engage the workpiece. If the workpiece contact element does not positively engage the workpiece, the power source valve sleeve cannot close the combustion chamber. Thus, ignition will be prevented.

Accordingly, there is a need for an improved workpiece contact element for a combustion nailer configured for enabling actuation of the tool when the magazine is arranged generally parallel to the workpiece. There is also a need for an improved combustion nailer workpiece contact element which more positively engages or grips the workpiece.

BRIEF SUMMARY OF THE INVENTION

The present workpiece contact element meets or exceeds the above-identified needs. Specifically, the present workpiece contact element includes teeth constructed and arranged for more stably engaging the workpiece than current workpiece contact elements. Also, the present workpiece contact element is configured for engaging the workpiece such that the tool can be actuated when the magazine is arranged generally parallel to the workpiece.

More specifically, a combustion-powered driving tool for propelling fasteners into a workpiece includes a housing, a power source located in the housing, a nosepiece connected to a lower end of the power source, a magazine associated with the housing and constructed and arranged for storing and sequentially feeding a plurality of fasteners to the nosepiece, and a workpiece contact element associated with the nosepiece and including at least one tooth extending from the workpiece contact element and being constructed and arranged for gripping the workpiece to enable the tool to drive a fastener when the magazine is arranged generally parallel to the workpiece.

In another embodiment, a workpiece contact element is provided for use with a combustion-powered driving tool for propelling fasteners into a workpiece, the tool including a housing, a power source located in the housing, a nosepiece associated with a lower end of the power source, and a magazine associated with the housing and configured for storing and sequentially feeding a plurality of fasteners to the nosepiece. The workpiece contact element includes a nose section constructed and arranged for generally surrounding the nosepiece, and at least one tooth extending from the nose section between the magazine and the nosepiece and constructed and arranged for engaging the workpiece when the tool is oriented so that the magazine is generally parallel with the workpiece.

In still another embodiment, a workpiece contact element is provided for use with a combustion-powered driving tool for propelling fasteners into a workpiece, the tool including a housing, a power source located within the housing, a nosepiece associated with a lower end of the power source, and a magazine associated with the housing and configured for storing and sequentially feeding a plurality of fasteners to the nosepiece. The workpiece contact element includes a nose section constructed and arranged for generally surrounding the nosepiece, the nose section having a generally rectangular cross-section viewed transversely to a longitudinal axis of the tool, the nose section having a front wall, a rear wall and a pair of sidewalls. A pair of generally pointed teeth extending distally from the rear wall, being located between the magazine and the nosepiece and constructed and arranged for engaging the workpiece and for enabling actuation of the combustion-powered tool when the magazine is arranged generally parallel to the workpiece.

DETAILED DESCRIPTION OF THE INVENTION

Figure 1:
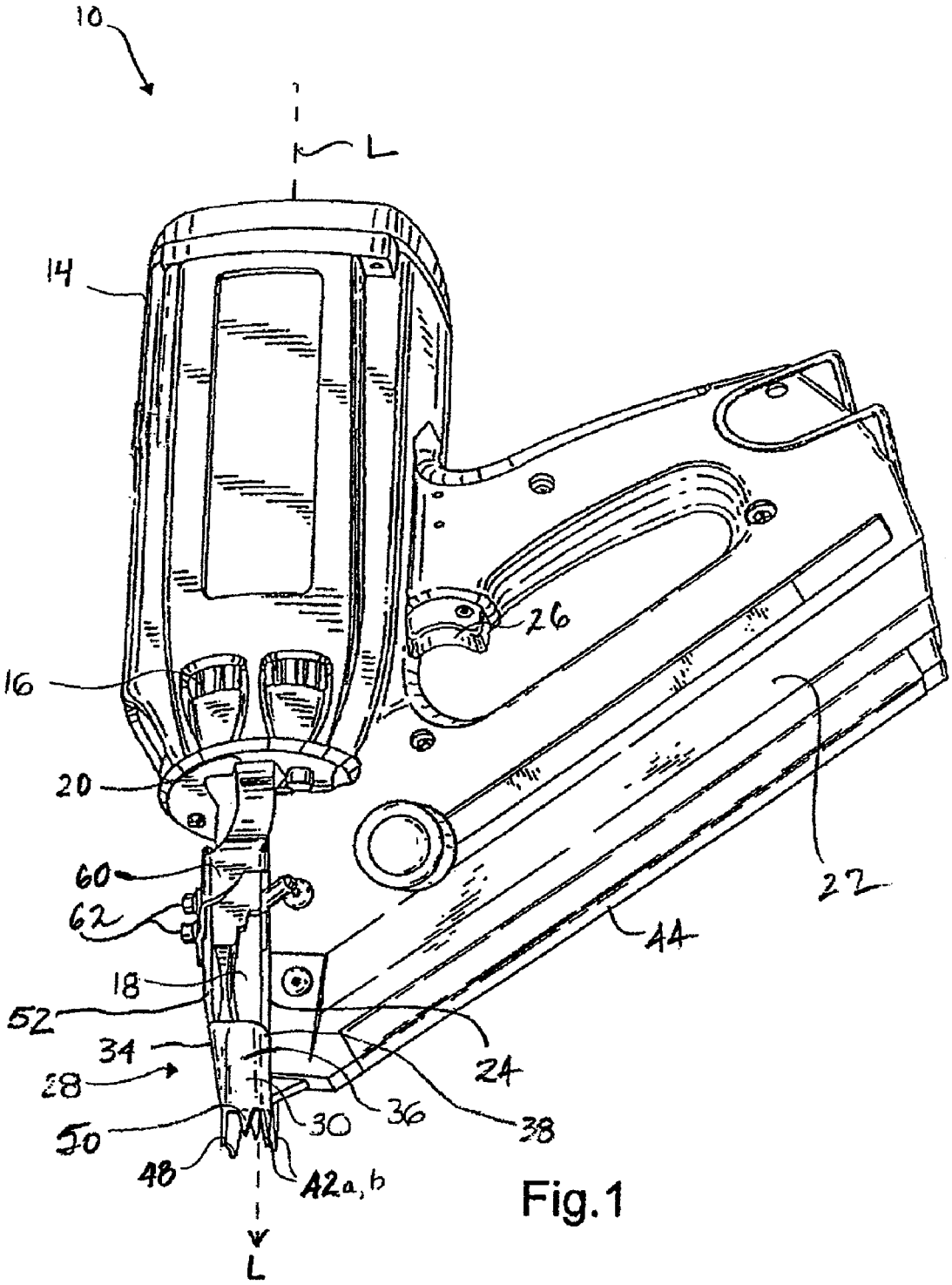
FIG. 1 is a side perspective view of a combustion powered fastener driving tool including the present workpiece contact element.
Figure 2:
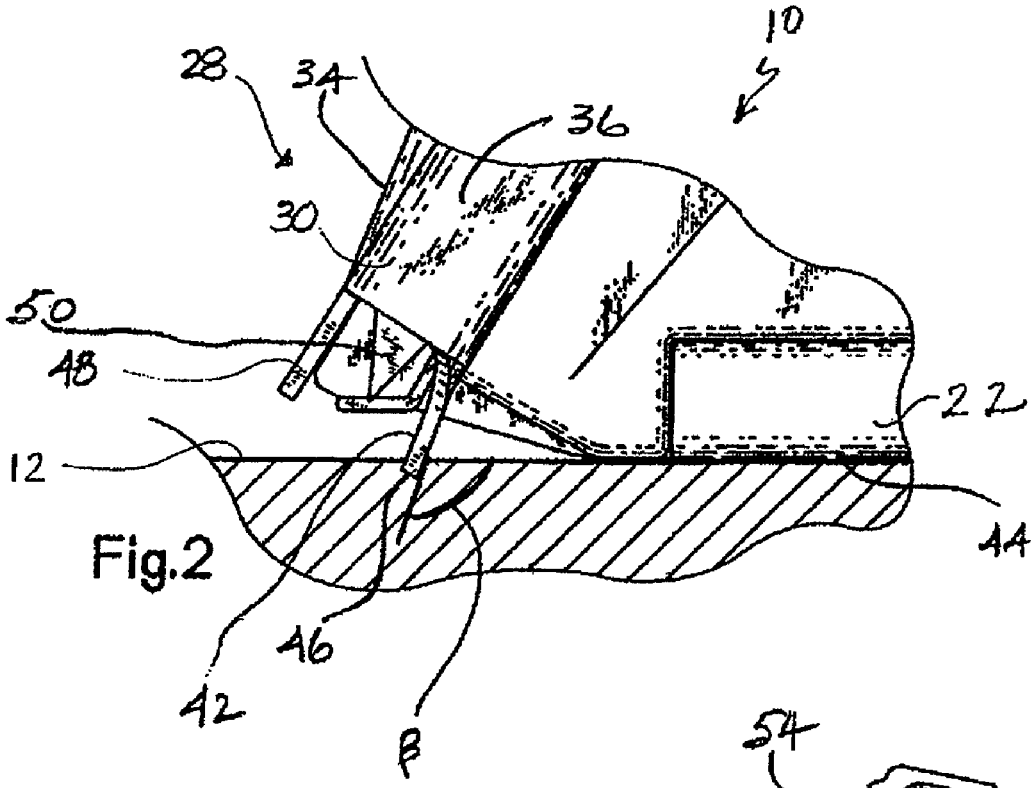
FIG. 2 is a fragmentary side view of the present workpiece contact element engaging a workpiece.

Referring to FIGS. 1 and 2, a combustion-powered fastener driving tool is generally designated 10 and is configured for sequentially propelling a plurality of fasteners (not shown) into a workpiece 12. The operation of the tool 10 is described in greater detail in the patents made of record above and need not be repeated here. As known in the art, the tool 10 generally includes a housing 14 enclosing a power source 16. The power source 16 includes a cylinder (not shown) for accommodating a reciprocating piston (not shown). A nosepiece 18 is attached to a lower end 20 of the power source 16, and a magazine 22 is associated with the housing 14 as is known in the art. The magazine 22 is constructed and arranged for storing and sequentially feeding a plurality of fasteners to a nail entry end 24 of the nosepiece. It will be seen that the tool 10 also includes a trigger 26 for initiating combustion, as known in the art.

Figure 3:
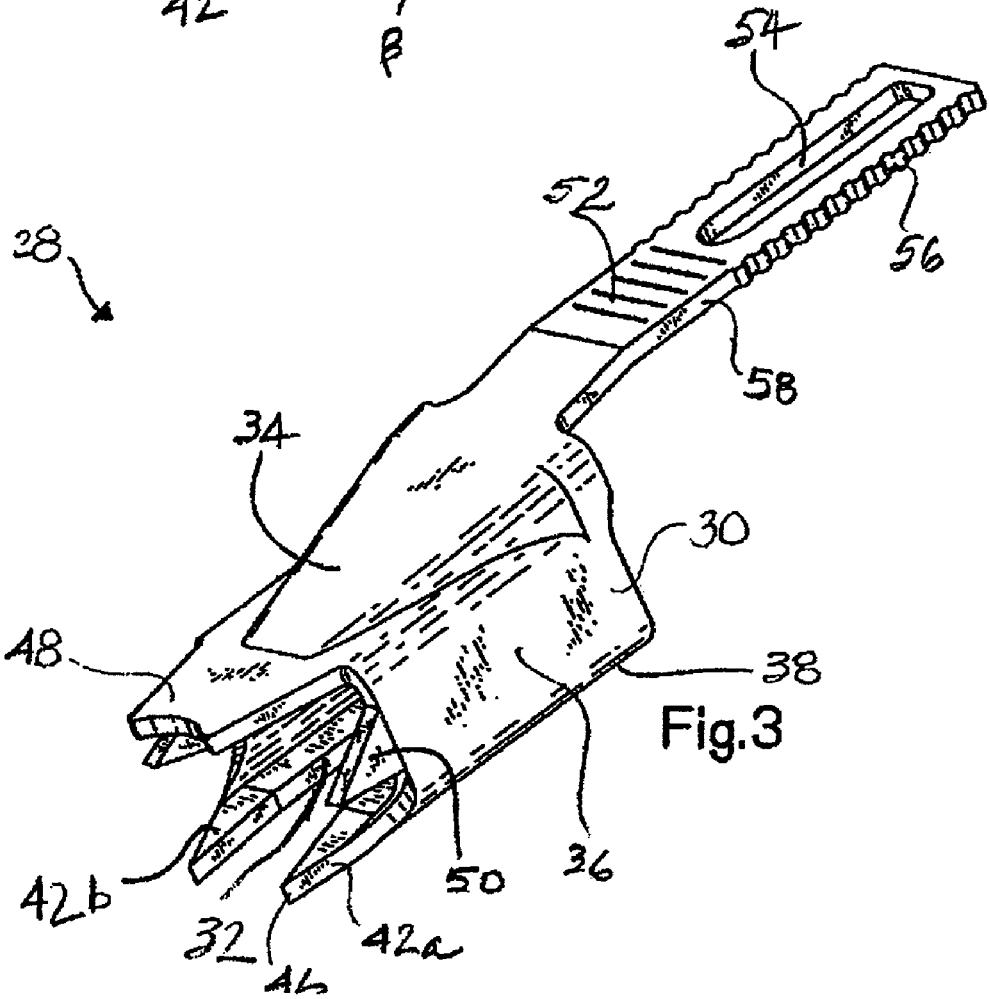
FIG. 3 is a front perspective view of the present workpiece contact element.
Figure 4:
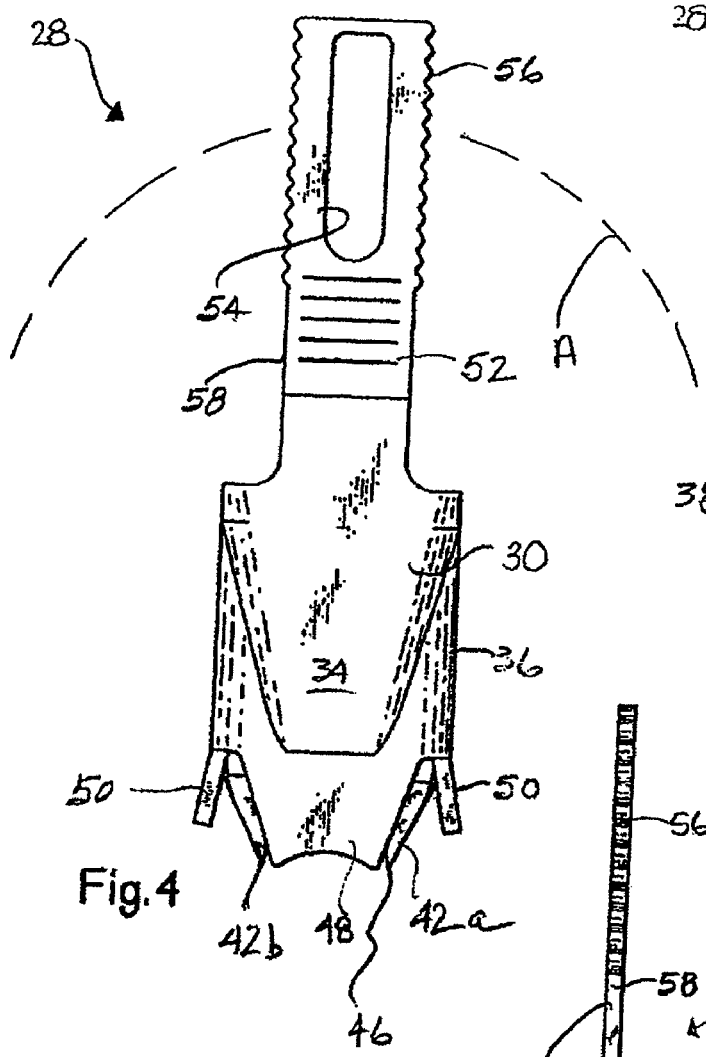
FIG. 4 is a front view of the workpiece contact element of FIG. 3.
Figure 5:
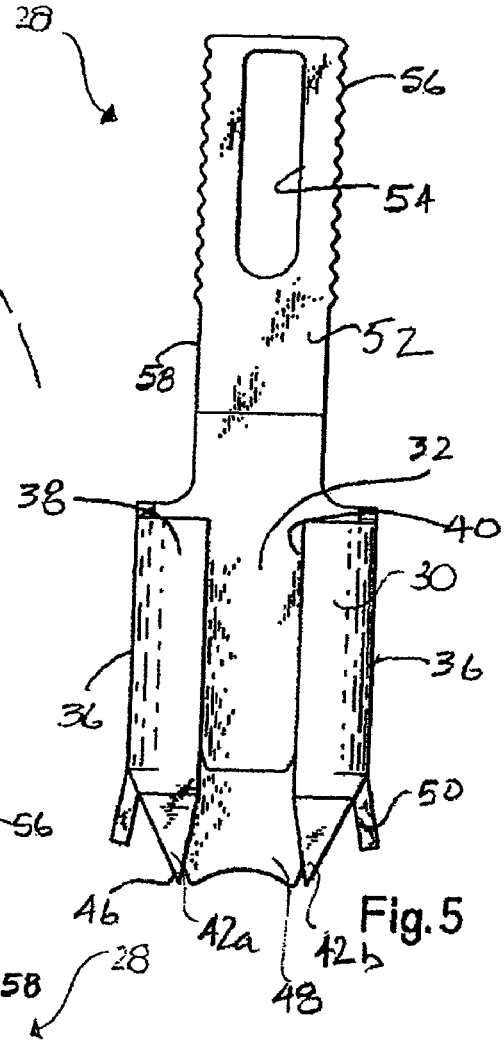
FIG. 5 is a rear view of the workpiece contact element of FIG. 3.

As seen in FIGS. 1-6, the tool 10 further includes a workpiece contact element 28 associated with the nosepiece 18 and constructed and arranged for gripping the workpiece 12 during actuation of the tool 10. The workpiece contact element 28 includes a nose section 30 constructed and arranged for surrounding the nosepiece 18. As is known in the art, the nosepiece 18 has a rectangular cross-section taken transversely to a longitudinal axis "L" of the power source 16. Similarly, the nose section 30 defines a rectangular space 32 for generally surrounding and slidingly accommodating the nosepiece 18. More specifically, the space 32 is defined by a front wall 34, a pair of side walls 36 and a rear wall 38. To accommodate the entry of fasteners from the magazine 22, the rear wall 38 is provided with a gap 40 (FIG. 5). To protect against breakage due to the forces generated during operation of the tool 10, it is contemplated that the workpiece contact element 28 including the nose section 30, is integrally formed. However, fabrication is also envisioned.

Preferably, the workpiece contact element 28 further includes at least one tooth 42 and preferably a pair of teeth 42*a*, 42*b*, extending from corresponding portions of the rear wall 38 on each side of the gap 40, and being located between the magazine 22 and the nosepiece 18. It is contemplated that each tooth 42 is constructed and arranged for positively gripping the workpiece 12 and enabling the tool 10 to actuate when an edge 44 of the magazine 22 is arranged generally parallel to the workpiece as shown in FIG. 2. In FIG. 2 the magazine is actually parallel to the workpiece; however variations in that positioning are contemplated depending on the application situation. Such an orientation is generally used during framing operations such as "toe-nailing," where a nail or other fastener is propelled at an angle to join two perpendicularly arranged workpieces.

Figure 6:
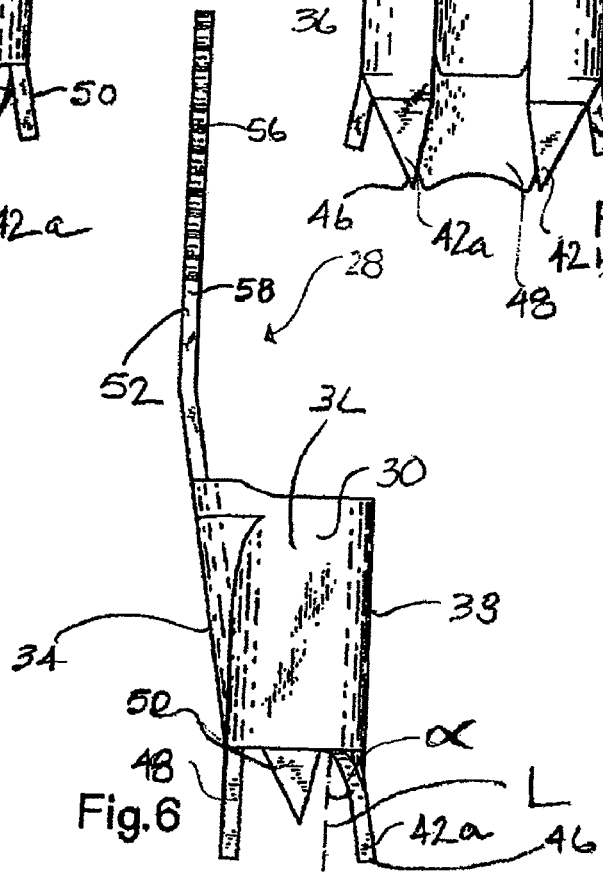
FIG. 6 is a side view of the workpiece contact element of FIG. 3.

Referring now to FIGS. 1, 2 and 6, each tooth 42 is arranged approximately at a 10° angle, $\alpha$, from the longitudinal axis "L" of the tool 10 and extends distally from the nose section 30 slightly rearwardly toward the magazine 22. To prevent bending/breakage during use, it is contemplated that each tooth 42 is integrally formed with the nose section 30. It is further contemplated that the preferred 10° angle orients the tooth 42 at an oblique, perpendicular, or otherwise transverse angle $\beta$ relative to the edge 44 of the magazine 22. This angular disposition enables the tooth 42 to firmly engage the workpiece 12 when the tool 10 is oriented such that the magazine 22 and especially the edge 44, is parallel to the workpiece. However, it is recognized that a variety of angles may be suitable, depending on the application, provided a positive engagement with the workpiece, is achieved. Each tooth 42*a*, 42*b* has a generally pointed end 46 distally located from the nose section 30 and configured for more securely gripping the workpiece 12.

As seen in FIGS. 3 and 6, the nose section 30 includes at least one prong 48 projecting from the front wall 34 located opposite from the teeth 42*a*, 42*b* and spaced from the teeth by the space 32 to be further away from the magazine 22 than the teeth. Conventional combustion fastener driven tools include a single prong 48, as shown. However, it has been found that such prongs are not positioned to positively grip the workpiece during toenailing. Preferably, each one of the teeth 42*a*, 42*b* extends farther distally from the nose section 30 than does the prong 48. The prong 48 preferably extends distally from the front wall 34 along the longitudinal axis "L" of the tool 10.

The nose section 30 further includes a pair of side teeth 50, each projecting from a corresponding side wall 36 and located between the prong 48 and one of the teeth 42*a*, 42*b*. The side teeth 50 preferably extend a shorter distance from the nosepiece 30 than the teeth 42, and the prong 48, to provide support and balance to the workpiece contact element 28 when the teeth are embedded in the workpiece 12. It is contemplated that the prong 48 and pair of side teeth 50 will provide additional support and balance during actuation of the tool 10 when the teeth 32 are embedded in the workpiece 12. As seen in FIGS. 4 and 5, the side teeth 50 each are splayed outwardly away from the side wall 36 of the nose section 30. Also seen in FIG. 4, the side teeth provide additional stability in the event the tool 10 is used to drive a fastener on an angle to the axis 'L' by tilting the tool along an arc 'A'.

Opposite the teeth 42, 50, the nose section 30 includes an axially projecting linear tongue or strap 52. The tongue 52 has a central elongated slot 54, as well as laterally projecting teeth 56 on outside edges 58. These components are employed in adjusting the relative position of the workpiece contact element 28 relative to an upper probe 60 (FIG. 1). As is known in the art, the upper probe is connected to a valve sleeve (not shown) which cyclically closes the combustion chamber during fastener driving. Fasteners 62, such as threaded fasteners are used to make such linear adjustment between the workpiece contact element 28 and the upper probe 60 to vary the length and/or the driven depth of particular fasteners. A suitable fastener driven depth adjustment is described in commonly assigned U.S. Pat. No. 6,959,850, which is incorporated by reference. However, the use of other such depth adjustment systems is contemplated.

During toenailing, for example, the user orients the tool 10 such that the teeth 42*a*, 42*b* engage the workpiece 12 and the edge 44 of the magazine 22 is arranged generally parallel to the workpiece. Upon actuation of the workpiece contact element 28 and the trigger 26, a gas/air mixture in the combustion chamber is ignited. During combustion, the reciprocating piston and driver blade move axially within the power source 16 toward the workpiece 12. As the driver blade is forced out of the power source 16, it contacts the fastener and drives the fastener along the nosepiece 18 and into the workpiece 12. During toenailing, the fastener is driven at an angle to properly join the perpendicularly oriented workpieces, as known in the art. The desired angle of a toenailed fastener is in the general range of 45-60°.

In contrast to most current fastener-driving tools, which are difficult to actuate unless the magazine is arranged at an acute angle relative to the workpiece, it is contemplated that the present workpiece contact element 28 will allow actuation of the tool 10 regardless of the angle at which the magazine 22 is oriented relative to the workpiece 12, including when the magazine is arranged generally parallel or perpendicular to the workpiece. It is further contemplated that regardless of the orientation of the magazine 22 relative to the workpiece 12, the teeth 42*a*, 42*b* will securely engage the workpiece and permit proper driving of the fastener.

While a particular embodiment of the present combustion nailer workpiece contact element with enhanced gripping has been described herein, it should be appreciated by those skilled in the art that changes and modifications may be made thereto without departing from the invention in its broader aspects and as set forth in the following claims.

The invention claimed is:

1. A driving tool for propelling fasteners into a workpiece, comprising:

a housing;

a power source located in said housing;

a nosepiece connected to a lower end of said power source;

a magazine associated with said housing and constructed and arranged for storing and sequentially feeding a plurality of fasteners to said nosepiece; and a workpiece contact element associated with said nosepiece and comprising:

a nose section having a front wall, a rear wall, and a pair of sidewalls, wherein the rear wall is closer to the magazine than the front wall, and at least one rear tooth extending from the rear wall obliquely to a longitudinal axis of the nosepiece in a direction away from the front wall, and being constructed and arranged for gripping the workpiece to enable the tool to actuate when said magazine is arranged generally parallel to the workpiece.

2. The tool of claim 1, wherein the nose section is slidable along the longitudinal axis of the nosepiece for surrounding and slidingly accommodating said nosepiece, and said at least one rear tooth is located between said magazine and said nosepiece.

3. The tool of claim 2, wherein said at least one rear tooth extends from the rear wall at an oblique angle to an edge of said magazine, said edge being adapted to be in direct surface contact with the workpiece.

4. The tool of claim 2, wherein said at least one rear tooth is slanted at approximately 10° from the longitudinal axis of the nosepiece and extends distally from said nose section toward said magazine.

5. The tool of claim 1, wherein the at least one rear tooth comprises a pair of rear teeth each having a pointed end distally located from said nose section and constructed and arranged for engaging the workpiece.

6. The tool of claim 5, wherein said nose section has a generally rectangular cross-section and includes at least one prong extending from the front wall to be located opposite from said pair of rear teeth, and spaced from said teeth to be further away from said magazine than said teeth.

7. The tool of claim 6, wherein said nose section further includes a pair of side teeth, each extending from one of the sidewalls and being located between said prong and one of said rear teeth.

8. The tool of claim 7, wherein each of said side teeth extends obliquely from the respective sidewall in a direction away from the other sidewall.

9. A workpiece contact element for use with a driving tool for propelling fasteners into a workpiece, the tool including a housing, a power source located in the housing, a nosepiece associated with a lower end of the power source, and a magazine associated with the housing and configured for storing and sequentially feeding a plurality of fasteners to the nosepiece, the workpiece contact element comprising:

a nose section constructed and arranged for surrounding the nosepiece, said nose section having a front wall, a rear wall adapted to be positioned closer to the magazine than the front wall, and a pair of sidewalls; and at least one rear tooth extending obliquely from said rear wall in a direction away from the front wall, adapted to be located between the magazine and the nosepiece, and constructed and arranged for engaging the workpiece when the magazine is generally parallel to the workpiece.

10. The workpiece contact element of claim 9, wherein said at least one rear tooth is slanted at approximately 10° from a longitudinal axis of the nosepiece and towards the magazine.

11. The workpiece contact element of claim 9, wherein the at least one rear tooth comprises a pair of rear teeth.

12. The workpiece contact element of claim 11, wherein said rear wall has a gap, and said rear teeth are located on opposite sides of said gap.

13. The workpiece contact element of claim 9, wherein said nose section has a generally rectangular cross-section taken transversely to a longitudinal axis of the nosepiece, and includes a prong extending from the front wall to be located on an opposite side of said nose section from said at least one rear tooth, and being spaced from said at least one rear tooth to be further from the magazine than said at least one rear tooth.

14. The workpiece contact element of claim 13, wherein the at least one rear tooth extends farther distally from said nose section than said prong.

15. The workpiece contact element of claim 14, wherein said prong extends distally along the longitudinal axis of the nosepiece.

16. The workpiece contact element of claim 13, wherein said nose section further includes a pair of oppositely located side teeth, each formed between said prong and said at least one rear tooth, wherein said teeth are slanted relative to the longitudinal axis and diverge away from each other as said side teeth project farther from the nosepiece.

* * * * *